US005698277A

United States Patent [19]

Schueller et al.

[11] Patent Number: 5,698,277

[45] Date of Patent: Dec. 16, 1997

[54] FIRE-RESISTANT GLAZING

[75] Inventors: Franz Schueller, Aachen; Jakob Nieven, Vaals; Ralf Linden, Aachen; Andreas Geith, Köln, all of Germany

[73] Assignee: Saint-Gobain Vitrage, Courbevoie, France

[21] Appl. No.: 678,021

[22] Filed: Jul. 10, 1996

[30] Foreign Application Priority Data

Jul. 11, 1995 [DE] Germany ..... 195 25 263-2

[51] Int. Cl.[6] ..... E06B 3/24; B27N 9/00

[52] U.S. Cl. ..... 428/34; 428/137; 428/920; 428/921; 52/786.13

[58] Field of Search ..... 428/34, 131, 137, 428/364, 192, 920, 921; 52/786.13, 232

[56] References Cited

U.S. PATENT DOCUMENTS 4,264,681 4/1981 Girard et al. ..... 428/429
4,830,913 5/1989 Ortmans et al. ..... 428/34
5,079,054 1/1992 Davies ..... 428/34
5,106,663 4/1992 Box ..... 428/34

FOREIGN PATENT DOCUMENTS 0 049 204 B1 12/1985 European Pat. Off. .
1541371 A 2/1979 United Kingdom .

*Primary Examiner*—Donald Loney
*Attorney, Agent, or Firm*—Pennie & Edmonds LLP

[57] ABSTRACT

A fire-resistant glazing system has two silicate glass sheets (1, 2) which are kept at a distance at the edge via a spacer frame and via adhesive layers (6, 7, 8) and are connected to one another in a sealing manner. The interspace is filled with a hydrogel (9) containing a water-soluble salt. The spacer frame (3, 4, 5) comprises silicate glass strips. The lower thermal conduction of the glass strips compared with known spacer frames made from steel delays warming, which generally results in destruction of the glass sheet, of the edge region of the glass sheet facing away from the fire source. This enables a greater fire resistance period to he achieved for the same thickness of the glazing. Fire protection glasses having the same fire resistance classes, but lower thickness, can thus be produced.

5 Claims, 1 Drawing Sheet

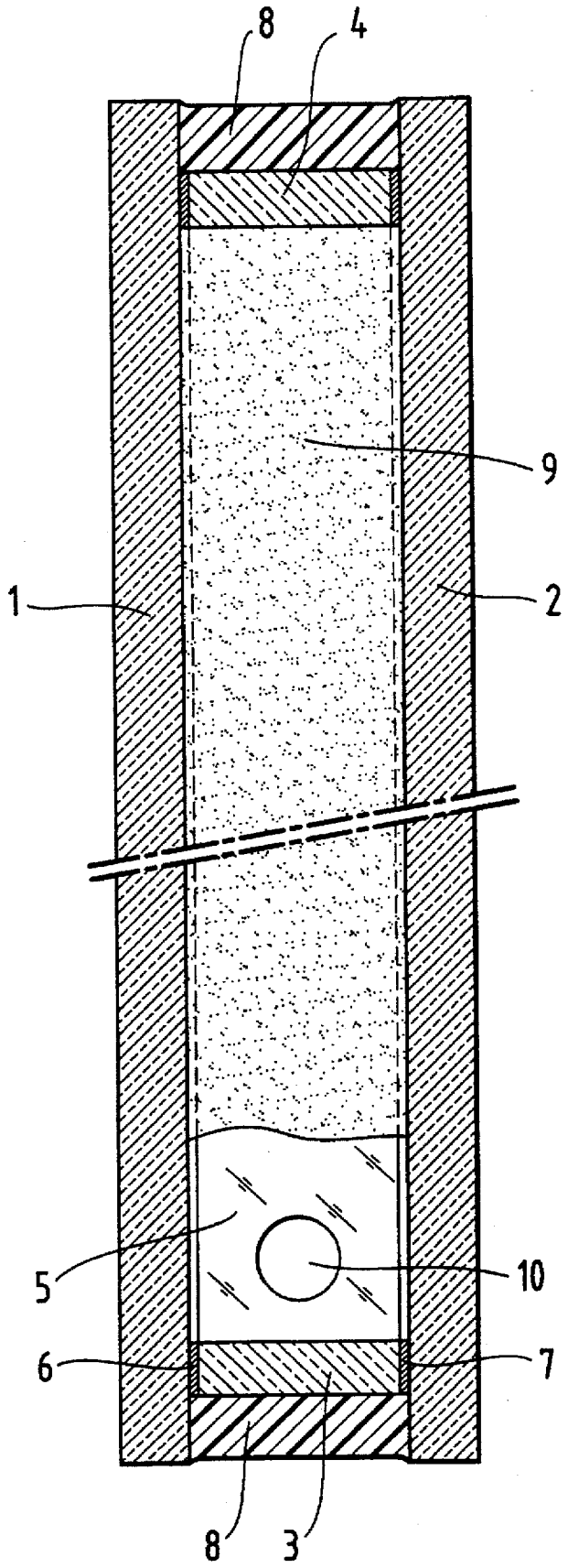
8
4
9
1
2
5
10
6
7
8
3

FIRE-RESISTANT GLAZING

BACKGROUND OF THE INVENTION

Description

The invention relates to fire-resistant glazing comprising two glass sheets which are connected to one another at the edge in a sealing manner via a frame-like spacer and whose interspace is filled with a hydrogel containing a water-soluble salt.

Fire-resistant glass sheets of this type are disclosed, for example, in the documents DE 2713849 C2, DE 3530968 C2, EP 0001531 B1 and EP 0049204 B1. In these known fire-resistant glazing systems, the spacer frame comprises profile sections of corrosion-resistant steel which are connected to one another by means of push-in comers, likewise of corrosion-resistant steel.

The fire-resistant action of such glazing systems in the event of fire is based on firstly absorption of considerable amounts of energy from the incident heat by the water, causing the water to evaporate. Evaporation of the water results in the formation of a foam-like heat shield from the salt. During evaporation of the water, the surface temperature of the glazing increases only insignificantly on the side facing away from the heat source and remains beneath the DIN 4102-accepted value of 140K above the initial temperature. The foam-like heat shield formed after evaporation of the water takes on the task of heat insulation during the remainder of the event and in particular prevents the passage of heat radiation through the glazing. Depending on the thickness of the gel layer, fire-protection glasses which conform with fire resistance Classes F 30, F 60 or higher classes in accordance with DIN 4102, Part 2, can be produced in this way.

In fire-resistant glazing systems having this known structure, gel layer thicknesses of at least 15 mm, depending on the thickness and type of glass sheets used, are necessary in order to satisfy the conditions of fire resistance Class F 30. For example, if two prestressed glass sheets with a thickness of 5 mm each are used, the thickness of the glazing unit is consequently at least about 25 mm.

In some cases, there is interest in employing glazing systems of said the having a certain fire resistance class, but with a smaller ovarall thickness of the glazing unit. For example, such a requirement can arise for reasons of weight reduction or owing to certain frame design which limits the thickness dimentions of the glazing.

SUMMARY OF THE INVENTION

The invention has the object of modifying the structure of these known fire-resistant glazing systems in such a way that the fire-protection action is further increased. In particular, it is an object to achieve an equally good fire-protection action as in known fire-protection glasses with a smaller overall thickness of the glazing.

This object is achieved in accordance with the invention through the spacer frame between the two glass sheets comprising a heat-resistant material having a coefficient of thermal conductivity of <2 kcal/mhK.

BRIEF DESCRIPTION OF THE DRAWINGS

The drawing shows a novel fire-protection glazing system in vertical section.

The invention is based on the observation that, in fire trials on known glazing systems, the destruction of the fire-protection glazing generally commences the edge. The water apparently evaporates in the vicinity of the metallic spacers more rapidly than over the remainder of the glass area. This results in the edge region on the glazing side facing away from the fire source warming up more rapidly than the central area and consequently being weakened more rapidly in comparison with the centre of the glass, which ultimately results in destruction of the glazing commencing at the edge region.

The invention significantly slows the heating of the glazing in the edge region by using spacers having a significantly lower coefficient of thermal conductivity than steel, thus significantly extending the fire resistance period for the same thickness of the glazing unit. This enables the same fire resistance duration as in known glazing units to be achieved for a significantly smaller thickness of the glazing unit.

Ceramic- or silicate-based heat-resistant materials are preferably used for the spacers. Such materials have a relatively low coefficient of thermal conductivity in the order of from 0.5 to 1 kcal/mhK, while corrosion-resistant steel has a coefficient of thermal conductivity of from 15 to 45 kcal/mhK. In addition, these materials have the particular advantage of being insensitive as such to the aggressive salt solution in the glazing cavity, so the addition of special corrosion-protection substances, as proposed in DE 3530968 C2 even when spacer frames made from corrosion-resistant steel are used, is superfluous.

Materials which have proven particularly suitable for the spacer are rods, strips or profiles of silicate glass, more precisely conventional float glass. This is because, when silicate glass strips are used, the conventional sealing system comprising an inner adhesive seal of butyl, i.e. a copolymer of isobutylene and isoprene, and an outer adhesive seal of thiokol, i.e. a thermoplastic polymer of the alkylpolysulphide group, can be retained unchanged. Advantageously, the adhesion between hydrogel and spacer frame may be improved if the frame is coated with a primer. When the spacer frame is made of standard soda lime glass the primers described in EP-B-0 001 531 are well adapted. In this document are described primers based on silanes able to react with the C-C double or triple bonds of the hydrogel or based on organic titanares or zirconares.

If another ceramic or silicate material is used, it may be necessary to match the adhesive system to the ceramic or silicate material.

In addition to said favourable properties, a fire-resistant glazing system designed in accordance with the invention has the advantage that, owing to the low thermal conduction in the spacer frame, no special measures need be taken for heat insulation through the installation frame of the glazing. This means, for example, that a relatively deep insertion depth of the glazing in the installation frame, i.e. considerable coverage by the installation frame in the edge region of the glazing, is unnecessary. Fire-resistant glazing systems designed in accordance with the invention can thus be installed in significantly narrower frame constructions, which gives the fire-resistant wall as a whole a lighter appearance.

In general, fire-protection glasses, like other glazing systems, have a rectangular shape, so that the spacer frame is composed of straight sections. However, it is of course also possible to produce novel fire-protection glasses in any other desired shape. For example, if glass is used as the material for the spacer, the glass strips can, after warming to their bending temperature, be bent into any desired shape, and thus, for example, round or semiround fire-protection glasses can also be produced.

DETAILED DESCRIPTION OF THE INVENTION

Further features and advantaged of the invention are evident from the patent claims and the following description of a preferred illustrative embodiment with reference to the drawing.

The glazing system comprises two silicate glass sheets 1, 2, each wiih a thickness of 5 mm and each made from thermally prestressed float glass. The spacers between these two glass sheets 1, 2 are glass strips 3, 4, 5 with a width of 12 m made, for example, from float glass which a thickness of 4 m. These glass strips 3, 4, 5 are bonded to the two glass sheets 1, 2 via adhesive layers 6, 7 of butyl. The channel between the glass strips 3, 4, 5 and the edge regions of the glass sheets 1, 2 is filled with an adhesive sealant composition 8 made from a polysulphide. The interspace formed in this way between the two glass sheets 1, 2 is filled with a salt-containing hydrogel 9.

In order to enable filling of the interspace in the prepared double-glass sheet with the gel-forming liquid during production of the fire-protection glazing, the glass strip 5 is provided with a hole 10 or a corner cutout in the vicinity of its lower end. Likewise, the opposite glass strip, which is not visible in the section view, is provided with a hole serving as air removal aperture in the region of its upper end. These apertures, which must initially be kept open in a suitable manner, for example by introducing short tube sections into the holes, are of course sealed after polymerization of the gel former and after removal of the tube sections used for filling and air removal, by introduction of adhesive sealant composition.

During assembly of the spacer frame comprising the glass strips 3, 4, 5, special corner pieces, as used when spacer frames comprising metal profile sections are used, are unnecessary, since the individual glass strips are butted against one another. Whereas, in the conventional procedure using metallic spacers, a closed frame is first produced from profile sections and push-in corners and this frame is laid as a whole on one of the two glass sheets, in the novel fire-protection glazing the glass strips 3, 4, 5 are arranged individually one after the other on one of the two glass sheets after being coated on at least one edge surface with an adhesive layer of butyl. In this way, the closed spacer frame is first assembled as such on the glass sheet.

A fire test in accordance with DIN 4102, Part 2, Sections 6.1 to 6.2.5, was carried out using a fire-protection glazing system produced in this way. A fire test was also carried out using a fire-protection glazing system in which the spacer, likewise with a width of 12 mm, comprised, in accordance with EP 0049204 B1, a corrosion-resistant steel profile, but the remaining structure of the fire-protection glazing was identical to the novel fire-protection glazing. Whereas the fire-protection glass with the spacer frame of corrosion-resistant steel achieved a fire resistance period of 25 minutes, the novel fire-protection glass achieved a fire resistance period of 32 minutes and thus corresponded to fire resistance Class F 30.

We claim:

1. Fire-resistant glazing comprising at least two glass sheets having edges, said sheets being connected to one another at their edges in a sealing manner by a spacer in the form of a spacer frame and whose interspace is filled with a hydrogel containing a water-soluble salt, characterized in that the spacer frame between the two glass sheets (1, 2) comprises a heat-resistant material having a coefficient of thermal conductivity of <2 kcal/mhK.

2. Fire-resistant glazing according to claim 1, characterized in that the spacer frame comprises rods of ceramic material.

3. Fire-resistant glazing according to claim 1, characterized in that the spacer frame comprises silicate glass strips (3, 4, 5).

4. Fire-resistant glazing according to claim 3, characterized in that two silicate glass strips (5) of the spacer frame which are arranged opposite one another are each provided, in the region of their diagonally opposite ends, with a hole (10) or with a corner cutout as filling or air-removal aperture.

5. Fire-resistant glazing according to any one of the preceeding claims, characterized in that surfaces of the spacer frame in contact with the hydrogel are handled with a primer, of which, in case of silicate glass, a primer on the basis of a silane able to react with the C-C double or triple bonds of the hydrogel or on the basis of organic titanates or zirconates.

* * * * *